US007233297B1

(12) United States Patent
Harvey et al.

(10) Patent No.: US 7,233,297 B1
(45) Date of Patent: Jun. 19, 2007

(54) STEERABLE RADIAL LINE SLOT ANTENNA

(75) Inventors: Robin J. Harvey, Newbury Park, CA (US); Franklin A. Dolezal, Reseda, CA (US)

(73) Assignee: HRL Laboratories, LLC, Malibu, CA (US)

( * ) Notice: Subject to any disclaimer, the term of this patent is extended or adjusted under 35 U.S.C. 154(b) by 0 days.

(21) Appl. No.: 10/890,574

(22) Filed: Jul. 13, 2004

(51) Int. Cl.
*H01Q 13/10* (2006.01)

(52) U.S. Cl. ..... 343/770; 343/768

(58) Field of Classification Search ..... 343/767–771
See application file for complete search history.

(56) References Cited

U.S. PATENT DOCUMENTS

| | | | | |
|---|---|---|---|---|
| 2,711,440 | A * | 6/1955 | Rines | 342/179 |
| 4,697,272 | A | 9/1987 | Harvey | 372/99 |
| 4,716,415 | A * | 12/1987 | Kelly | 343/771 |
| 5,175,561 | A | 12/1992 | Goto | 343/769 |
| 6,124,833 | A * | 9/2000 | Bialkowski et al. | 343/770 |
| 6,542,130 | B2 * | 4/2003 | Falk et al. | 343/771 |
| 6,737,938 | B2 * | 5/2004 | Kitamori et al. | 333/161 |
| 6,853,344 | B2 * | 2/2005 | Huor | 343/767 |

OTHER PUBLICATIONS

Ando, M., et al., "A Radial Line Slot Antenna for 12 Ghz Satellite TV Reception," *IEEE Transactions on Antennas and Propagation*, vol. AP-33, No. 12, pp. 1347-1352 (Dec. 1985).
Hirokawa, J., et al., "Waveguide Array," *IEE Proceedings*, vol. 137, Pt. H., No. 6, pp. 367-371 (Dec. 1990).
Takahashi, M., et al., "Characteristics of Small-Aperture, Single-Layered, Radial-Line Slot Antennas," *IEE Proceedings-H*, vol. 139, No. 1, pp. 79-83 (Feb. 1992).
Yamamoto, T., et al., "Application of Radial Line Slot Antenna to Millimeter-Wave Systems at 60Ghz Band," *IEEE*, pp. 62-65 (1996).

* cited by examiner

*Primary Examiner*—Shih-Chao Chen
(74) *Attorney, Agent, or Firm*—Ladas & Parry

(57) ABSTRACT

A steerable antenna comprising an array of T-shaped slots. The location of the slots is moved to define an array of ring- or spiral-patterned phase constant regions. Distortions or contractions of the pattern occur by repositioning some or all of the slots forming the array. The antenna also comprises an intermediate insulating layer and a lower plate. The insulating layer is formed by a deformable dielectric medium. Deformation of the dielectric medium allows the beam angle to be altered.

38 Claims, 6 Drawing Sheets

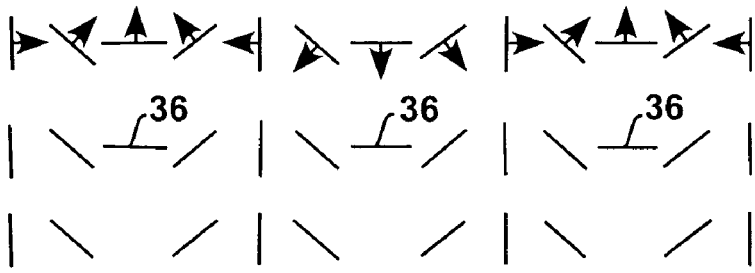
FIG. 13A
FIG. 13B
FIG. 13C
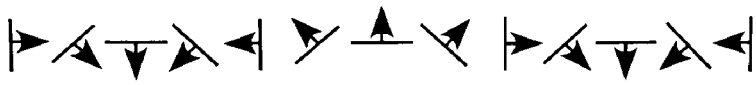
FIG. 13D
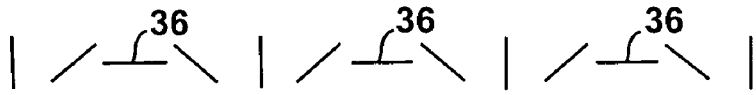
FIG. 13E
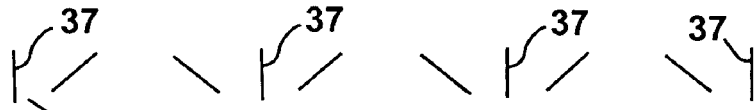
FIG. 13F
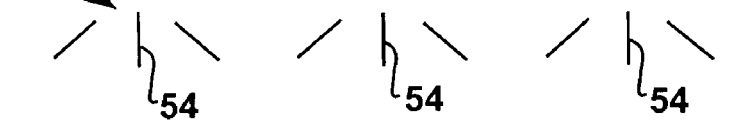
FIG. 13G
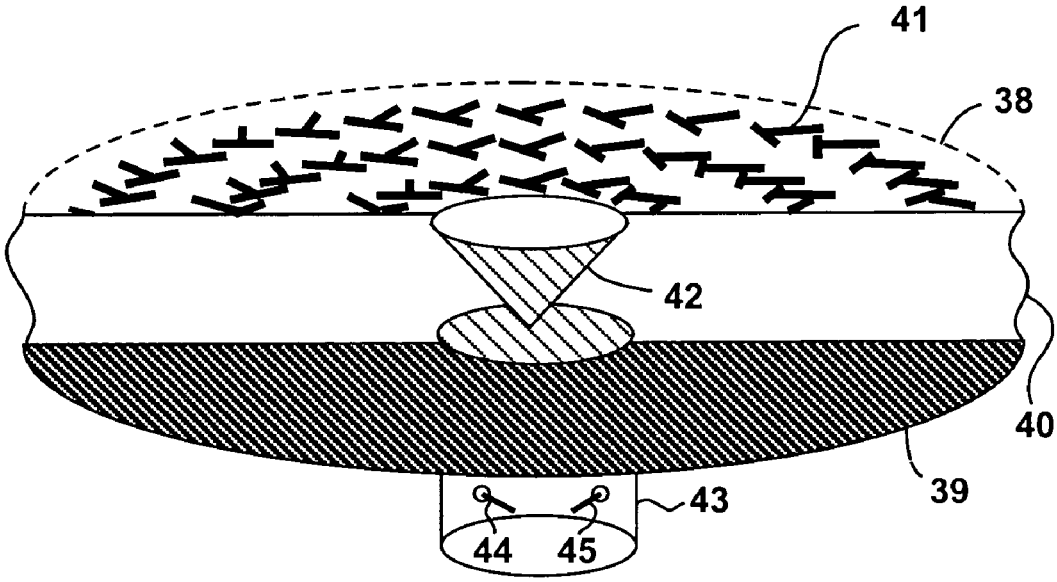
FIG. 14

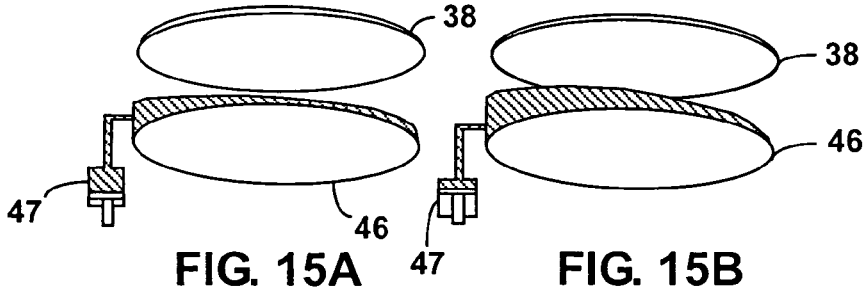
FIG. 15A FIG. 15B
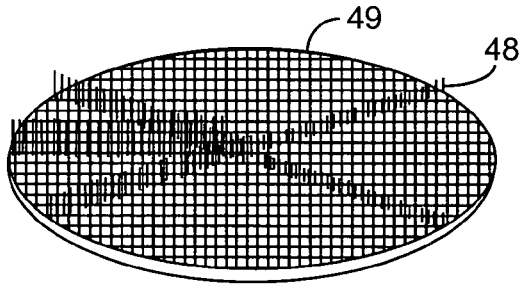
FIG. 16
FIG. 17A
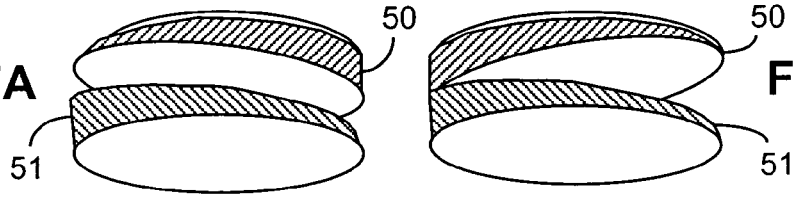
FIG. 17B
FIG. 17C
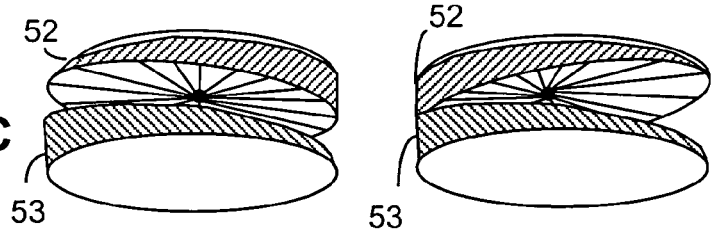
FIG. 17D

STEERABLE RADIAL LINE SLOT ANTENNA

BACKGROUND

1. Field

The present disclosure relates generally to antennas and more particularly to a steerable slot antenna comprising an array of slots in a planar waveguide.

2. Related Art

FIG. 1 shows a prior art radial line slot antenna for conversion of circular polarized waves to planar waveguide modes. See, for example, Takahashi, Takada, Ando, and Goto, IEEE Proc. H Vol 139, #1 Feb. 1992, page 77.

An upper plate 1 is provided with an array of crossed T-shaped slots 2, arranged in a spiral pattern as shown by dashed line 3. The slots 2 are designed to couple to left or right circularly polarized radiation. In particular, the spiral and slot orientations are designed to match the phase and E-vector angle of the incoming wave to the converging wave inside the waveguide.

T-configuration of each slot pair is known to suppress reflection in an optimal way, as illustrated, for example, in Hirokawa, Sakurai, Ando, Goto IEE Proc. H Vol. 137, # 6 Dec. 1990, page 367. The T-shaped slots 2 rotate along the spiral 3. The radial separation of the spiral rings of the spiral 3 is set to be one wavelength for propagation within the planar guide, after correcting for dispersion in the planar guide. As a consequence of the rotation of the T-shaped slots, the rotational phase of power coupled through the slots rotates as well. This enables the signal power within the guide to be in phase periodically in radius. In particular, the phase fronts are circular and propagate inward to a focus for the correct incident polarization.

The arrows 4 represent E-field orientation for the cylindrically symmetric TEM01 mode (with no z dependence and propagating radially inward). The circular pattern 5 represents the H field, uncorrected for phase shift from the E-field. A coaxial probe 6 in the center out-couples the vertical E-field.

A first disadvantage of this prior art is that it is a single polarization device. A second disadvantage is that the antenna does not show printing diversity. As a consequence, it is difficult, if not impossible at all, to keep the phase of the converging wavelets constant, independently of where the wave originated across the active surface of the guide.

SUMMARY

The present disclosure provides an antenna where not only the position of the single T-shaped slots but also their general pattern can be modified or changed, in order to obtain beam steering.

According to a first aspect, a steerable slot antenna is disclosed, comprising: an upper plate having an array of T-shaped slots arranged in a pattern having a shape; a plurality of actuators to control the shape of the pattern by repositioning plural slots of the array of T-shaped slots; a waveguide comprising a dielectric medium, the waveguide connected with the upper plate; and a lower plate connected with the waveguide. With the term T-shaped a configuration having the general shape of a T is intended. The segments forming the T do not necessarily touch each other and/or are not necessarily exactly at right angles.

According to a second aspect, an antenna is disclosed comprising: an upper plate comprising an array of slots; a lower plate; a deformable dielectric medium connecting the upper plate with the lower plate, whereby the upper plate, the dielectric medium and the lower plate form a planar waveguide; and a conical reflector placed within the dielectric medium.

According to a third aspect, a dual polarization antenna slotted antenna is disclosed comprising an array of independently rotatable slots, wherein rotation of the slots is controlled to allow polarization diversity.

According to a fourth aspect, a steerable antenna is disclosed comprising: an upper plate having a plurality of ridged mesa elements, wherein orientation and positioning of the mesa elements is controllable, to allow repositioning of the mesa elements along the upper plate; an insulating layer connected with the upper plate; and a lower plate connected with the insulating layer.

According to a fifth aspect, a steerable antenna is disclosed comprising: an upper plate having a plurality of elements having a deformable height, wherein the height and position of the elements is controllable; an insulating layer connected with the upper plate; and a lower plate connected with the insulating layer.

According to the present disclosure, a very thin steerable antenna (less than a wavelength thick) having a high overall efficiency, estimated to be between 75% and 85% can be provided. Left polarization or right polarization can be chosen with maximal sensitivity.

BRIEF DESCRIPTION OF THE DRAWINGS

The present disclosure will be understood and appreciated more fully from the following detailed description taken in conjunction with the drawings in which:

FIGS. 13A–13G show slot control by way of a discrete number of rotations of the slots;

FIG. 14 shows a cross-sectional view of an embodiment showing an upper plate, a lower plate, and a dielectric medium of a slotted antenna;

FIGS. 15A and 15B show an inflatable membrane bladder;

FIG. 16 shows an embodiment where dielectric rods are provided; and

FIGS. 17A–17D show embodiments where wedged disks are provided.

DETAILED DESCRIPTION

According to the present disclosure, the location of the slots is moved to match the required phase shift with incident angle and position. In this way, the phase of the converging wavelets arriving at the detector will be kept constant, independent of where the wave originated across the active surface of the guide. This defines an array of alternating phase constant regions that are typically ring- or spiral-patterned depending upon the mode conversion technique employed.

Figure 1:
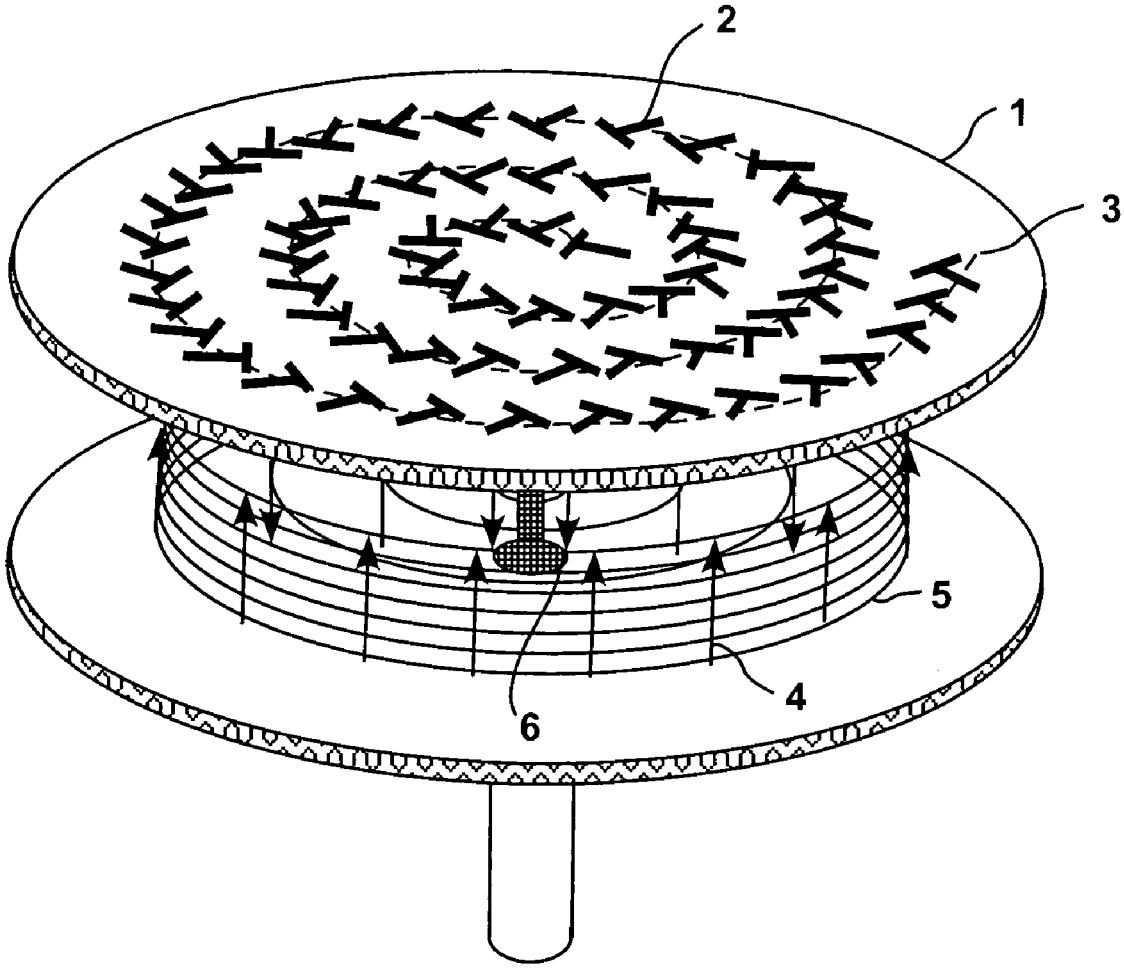
FIG. 1 (PRIOR ART)
FIG. 1, already described in detail, shows a prior art radial slotted antenna.
Figure 2:
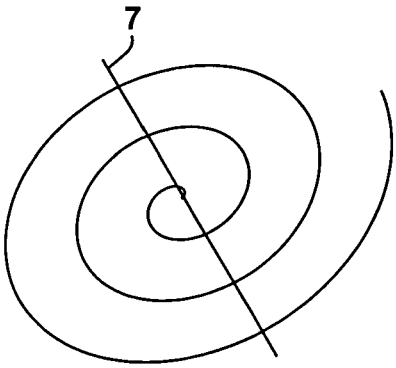
FIGS. 2–4 show ring pattern changes in the antenna according to the present disclosure.
Figure 3:
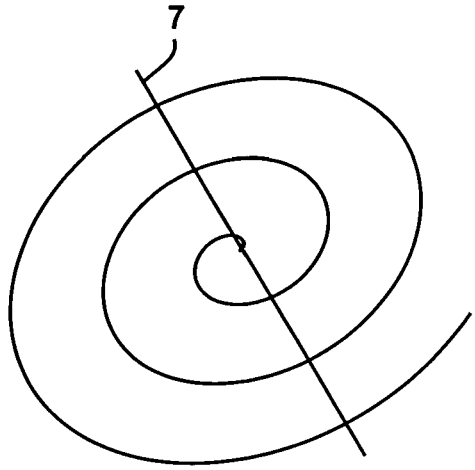
Figure 4:
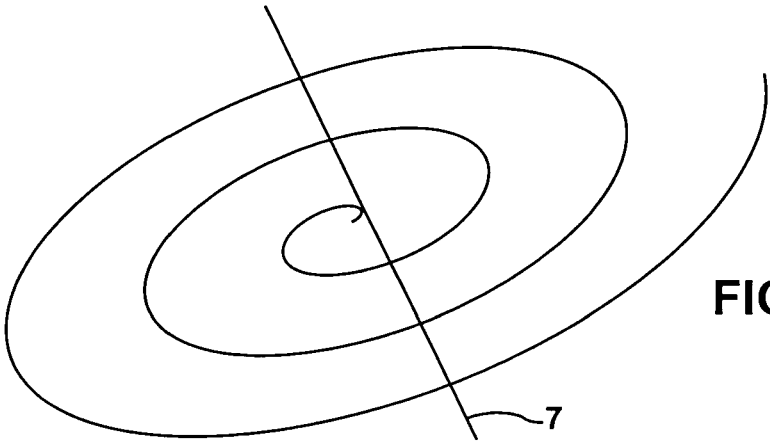

FIGS. 2–4 show how the ring patterns are changed in the antenna according to the present disclosure, where reference is made to a spiral-patterned embodiment. In the case of nested rings, a similar general deformation occurs. In particular, the change in center location and shape is similar to that of the spiral case, so that the pattern appears locally similar to that of the spiral. The intent of the deformation is to change the effective focal depth or angle of the antenna beam and/or to change the frequency band of the antenna.

FIG. 2 shows the overall mechanical deployment of the slots in case of normal incidence, where the axis 7 of the spiral is also shown.

FIG. 3 shows a first possible distortion or deformation of the pattern, where incident waves having a longer wavelength are countered by an expansion or increase in the overall size of the spiral pattern. Similarly, a distortion may comprise a contraction of the entire pattern. The distortions or contractions occur by repositioning some or all of the slots forming the spirally shaped array of FIG. 2. The expansion or contraction of the slot pattern changes the depth of focus of the antenna pattern in the far field and/or shifts the frequency band.

FIG. 4 shows a second possible deformation of the pattern, where deformation of the spiral pattern occurs primarily along one axis of the spiral. In particular, this distortion acts to tilt the angle at which the antenna is focused in the far field.

In the case of tilting, for large tilt angles (low azimuth), it may be important to change the slot length in the tilt direction, to optimize the coupling. A further way is that of deforming the dielectric medium filling the planar waveguide, as later explained. Therefore, the present invention also provides for embodiments where the length of the slots is changed to change center frequency and compensate for blaze angle corrections.

Repositioning of the slots, like scales on a snake, changes the phase orientation of the slot array and compensates for angular changes. The slot pattern is changed by means of actuators associated with the slots. The actuators are low cost and simple mechanical parts which have to move less than approximately one wavelength to achieve full angular view. Feedback loop controls can be of the conventional type.

Figure 5:
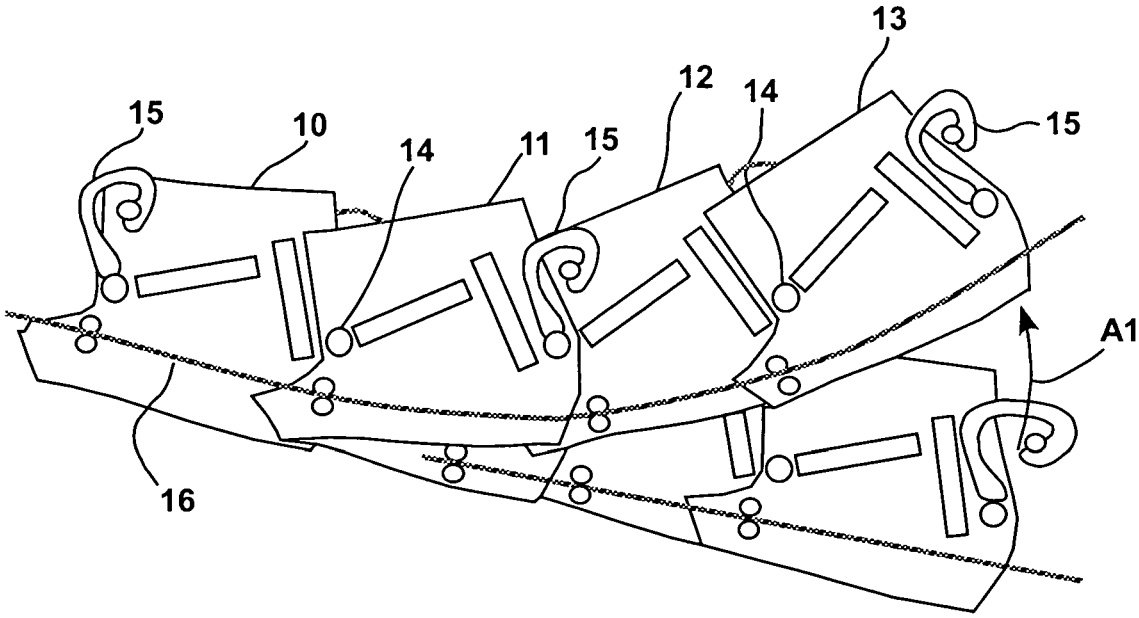
FIG. 5 shows an arrangement of slots, where movement along a radius is obtained.

FIG. 5 shows a first embodiment of an arrangement of slots according to the present disclosure, wherein movement along a radius is obtained. Slotted segments 10, 11, 12 and 13 are shown in two different positions, where the second position (top segments) is reached in the direction of the arrow A1 and is obtained by locally changing the pitch angle of the slot pattern which acts to change the radial position of a segment. In particular, the segments comprise hinge pivots 14 which allow each segment to be reoriented relative to an angle. Additionally, the segments comprise spring fingers 15 to provide torque control as a function of position along a length of mated segments. Motion of the segments 10–13 is obtained, for example, by an actuator (not shown) releasing or applying tension to a tensioning cable 16.

Tensioning of the cable 16 and torque inducement are obtained by means of the above discussed actuators. The actuators are usually placed at the ends of the circular or spiral sections.

Figure 6:
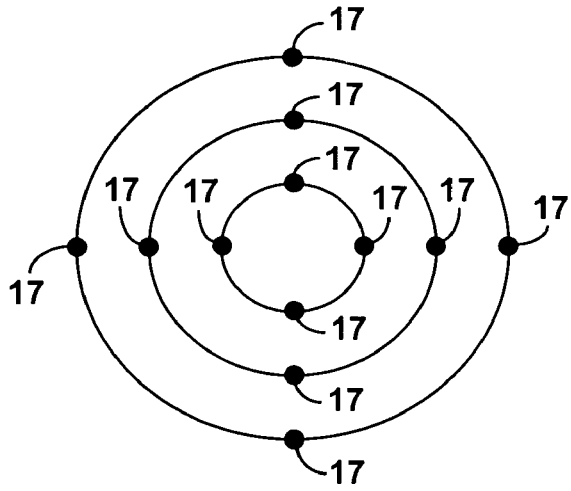
FIG. 6 shows a possible location of the actuators in case of a nested rings embodiment.

FIG. 6 shows a schematic representation of a nested ring pattern in the antenna, where the dots 17 represent locations where the actuators have been attached. The actuators will not be described in detail in the present application, because their operation is well known to the person skilled in the art.

Figure 7:
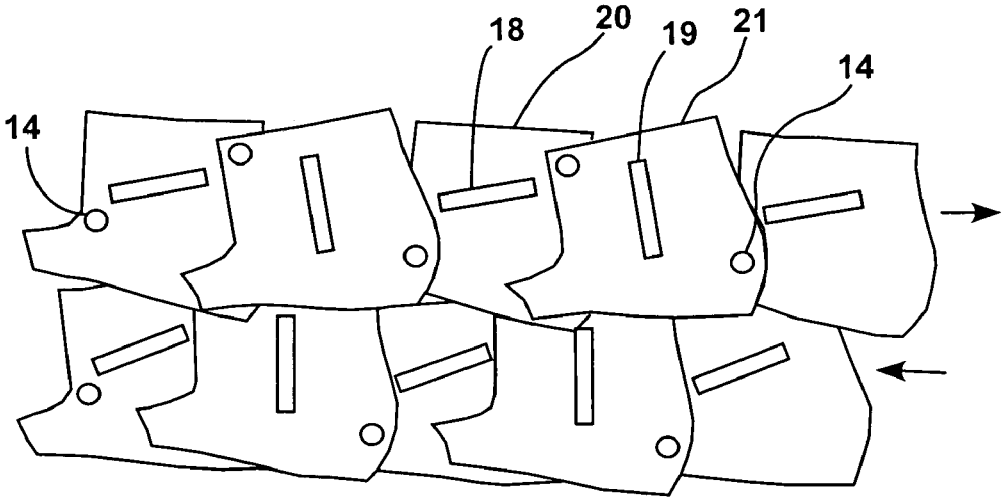
FIG. 7 shows a further arrangement of slots, allowing the slot pattern to either contract or expand.

FIG. 7 shows a second embodiment of an arrangement of slots according to the present disclosure, wherein movement is targeted towards contraction or expansion of the slot pattern. In particular, FIG. 7 shows that the distortion may be in the form of extension by offsetting the hinge positions 14. Additionally, in this embodiment, each portion 18, 19 of a T-shaped slot is contained in a different segment 20, 21, respectively.

The movement of the segments in FIGS. 5 and 7 is also obtained by means of the hinges 14. In particular, the moving slotted segments are supported by similarly constructed hinged baffles that fill in blank spaces between the slotted segments. The segments can be formed by metalized thin plastic parts. Metallization preferably extends around the dielectric element to better contact the baffles.

Figure 8:
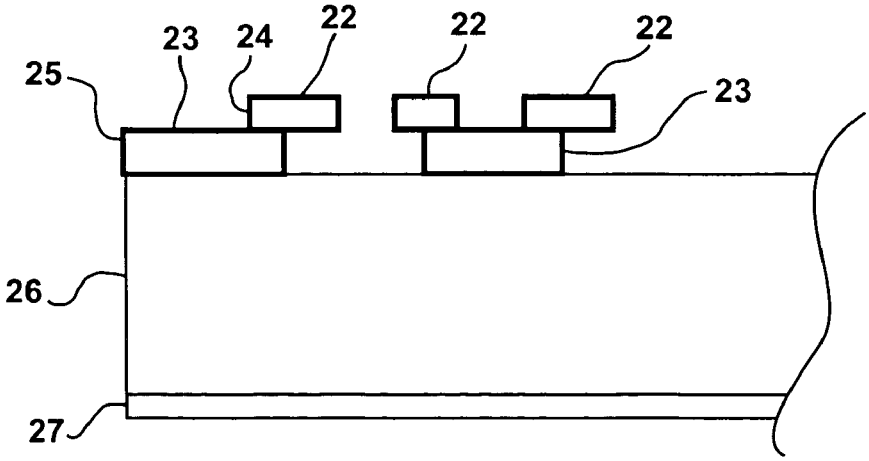
FIG. 8 shows slotted segments in a partial sectional view.

FIG. 8 shows slotted segments 22 and baffles 23 in a partial sectional view. Metallization is represented by a darkened peripheral side 24 of the segments 22 and 25 of the baffles 23. Also shown are the insulating layer 26 and the lower plate 27 of the antenna.

Further embodiments of the slotted segments or elements can also comprise segments functioning like Venetian blinds.

Alternatively, the segments can be organized as sliding overlapping segments that may be slid across each other or across a supporting structure forming the top surface of the waveguide. The spring fingers 15 of FIG. 5 can be molded tabs that provide spring loading to define a normal condition, a torqued condition and a range of motion.

Figure 9:
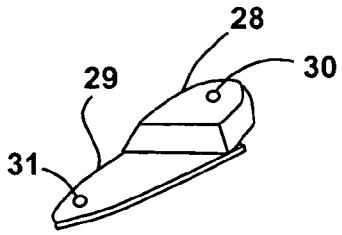
FIG. 9 shows a ridged mesa element.
Figure 10:
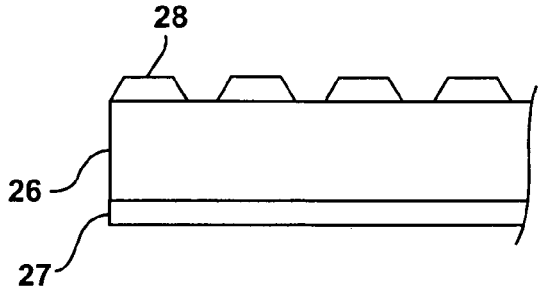
FIG. 10 shows a cross section of a group of elements shown in FIG. 9.

FIGS. 9 and 10 show a further embodiment, where instead of slotted segments, refracting and diffracting elements are used. FIG. 9 shows a ridged mesa element 28, connected to a gland section 29. Both the ridged mesa element 28 and the gland section 29 have hinges 30, 31. FIG. 10 shows a cross section of a group of elements 28 of FIG. 9. Also shown are the insulating layer 26 and the lower plate 27 of the antenna. The difference in optical path length through the section of the mesa element 28 is half a wavelength. Orientation and positioning of the mesa elements is controllable, to allow repositioning of the mesa elements along the upper plate. Also in this case the individual spring elements may comprise plastic spring elements molded to provide alignment spring forces and control of the spiral curvature with applied torque from an actuator.

Figure 11:
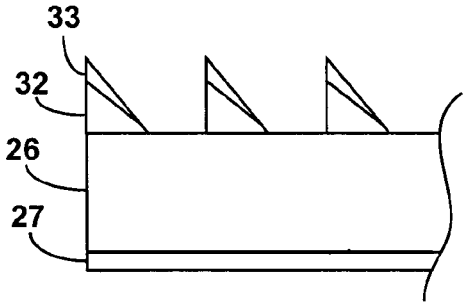
FIG. 11 shows elements having a deformable height.

FIG. 11 shows a further embodiment of the elements, where elements having a deformable height are shown. The height of the elements is deformed to correct the angle of refraction or reflection. The figure shows both a deflated condition 32 and an inflated condition 33 of the elements. Inflatable elements can be used by providing an additional actuator for pneumatic inflation of the elements. The correction of angle is included to improve the antenna efficiency by making use of blazing techniques well known to the makers of optical gratings. See also U.S. Pat. No. 4,697,272.

The embodiments of the previous figures can apply, for example, to phase constant regions, Fresnel zones, or zones shaped with Bessel function periodicity. For example, changing the position of a Fresnel zone has the effect of changing the frequency of operation.

According to a further embodiment of the present disclosure, the slotted antenna can act as a dual polarization device, i.e. an antenna that is able to receive two orthogonal polarizations, such as left circular polarization (LCP) and right circular polarization (RCP). Therefore, the present disclosure also provides for a single slotted antenna capable of communicating signals with polarization diversity.

According to the present disclosure, each slot is able to rotate to match the phase of the incoming planar wave with the phase of a spiraling Bessel-function-like TEM01 mode within the waveguide. Depending upon polarization and slot orientation, the mode may move inward or outward.

Figure 12:
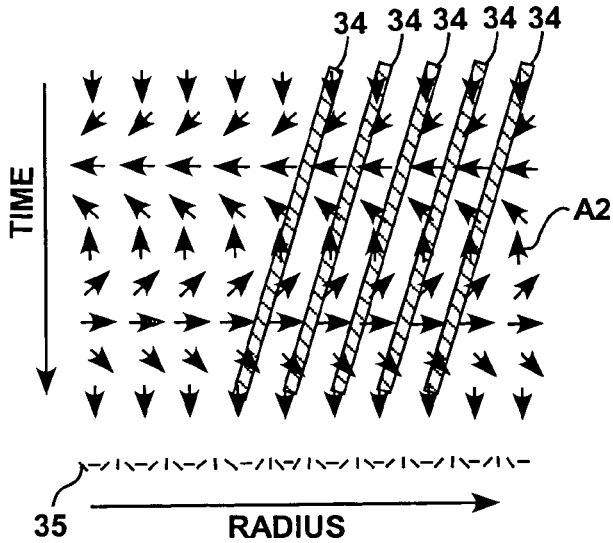
FIG. 12 shows the orientation of the slots as a function of radius in case of right circular polarization.

Reference will be made to an embodiment of the antenna containing nested rings, each ring comprising a plurality of slots. The person skilled in the art will understand that similar considerations apply to other embodiments, such as a spiral shape embodiment. In particular, FIG. 12 shows an array of arrows A2 indicating an incoming right circular polarization field as a function of time and radius of the nested rings. The lines 34 indicate phase coherent regions where the external fields couple power to a collapsing TEM spiral mode. The plurality of slots 35 at the bottom of the Figure shows how the slots in the rings are oriented as a function of radius in order to obtain RCP. Similar considerations can be made in the case of LCP.

Slot control can be obtained by rotating the slots either in a discrete or continuous manner.

FIGS. 13A–13F show an embodiment where slot control is obtained by providing each slot with a discrete number of possible rotations, e.g. ¼ wave rotations with 45 degrees change in angle.

For example, FIG. 13A shows slots rotating in a first sense of rotation, e.g. counter clockwise, every ¼ wave with 45 degrees changes in angle. FIG. 13B shows that some of the slots are radially oriented slots 36. Those particular slots do not contribute to coupling and may be blocked or omitted, as shown in FIG. 13C. Blocking of particular slots can be obtained by covering those slots with a movable structure, or otherwise shorting those slots across.

FIG. 13D shows slots rotating in a second sense of rotation, e.g. clockwise. FIGS. 13D, 13E, and 13F are similar to FIGS. 13A–13C. The clockwise pattern of FIG. 13F is topologically distinct from the counter clockwise pattern of FIG. 13C. However, the topology of the pattern of FIG. 13F can be adjusted by blocking slots 37 of FIG. 13F and opening vertical slots 54 at the location of the previously blocked slots 36. In this way, by vertically orienting previously blocked slots 36, FIG. 13G reconstructs the pattern of FIG. 13C with an offset in position, as shown by comparing FIG. 13C with FIG. 13G. The offset in position is equivalent to an overall phase shift and is unimportant. Therefore, it is possible by small mechanical motions, as with shutters, to quickly and effectively change the polarization of the antenna.

FIG. 14 shows a cross-sectional view of one embodiment of the slotted antenna according to the present disclosure. In particular, an upper plate 38, a lower plate 39, and a compressible medium forming an insulating layer 40, located between the upper plate 38 and the lower plate 39, are shown. The upper plate 38 contains a plurality of slots 41. The upper plate 38, the insulating layer 40, and the lower plate 39 form a planar waveguide. A conical coupling element or reflector 42 is placed in the medium 40. The slots 41 transform the incoming circularly polarized plane wave signal (typically from a distant satellite) into a collapsing cylindrical wave that spirals inward to the conical reflector 42. In other words, the conical reflector 42 reflects the converging TEM mode in the planar waveguide and transforms it into the equivalent (left or right circular) polarized TE11 mode at the entrance to the circular cavity of a conventional low noise block (LNB) 43 or a low noise amplifier array. The LNB 43, known as such to the person skilled in the art, selects the LCP or RCP wave by switching the phase of one of the two elements 44, 45 within the LNB that sense Ex±iEy polarization of the signal.

The E J coupling of power through the slots 41 defines the corresponding Poynting vector E×H that will be driven on the other side, hence the strength of the coupling into a given mode. By adjusting the strength of the coupling by means of the slot length, location and density, the antenna surface may be matched in impedance to that of free space and reflected modes canceled out, thus leaving only the desired internal modes of the waveguide activated. Assuming that there is ideal matching, all of the power entering the waveguide is matched to the inward traveling mode that is then fully absorbed in the LNB 43.

The antenna system of FIG. 14 also comprises actuator drive elements that react to the pointing error, or similar feedback signals for pointing or tracking. Those elements are not shown in the figure for clarity reasons.

As already explained above, beam pointing is obtained by moving some or all of the slots of the array of T-shaped slots. Additionally, beam pointing can be obtained by compressing the waveguide formed by the upper plate 38, insulating layer 40, and lower layer 39.

Deformation of the dielectric medium forming the insulating layer 36 allows the speed of light in the guide and the resulting beam angle to be altered. In particular, foam dielectric can be used to fill the planar waveguide, together with an orthogonal pair of actuators to compress the foam, changing the net index of refraction and hence the signal speed.

According to the present disclosure, correction of angular errors can also be obtained by means of waveguide media deformation, to be preferably combined with the movement of the location and/or orientation of the slots.

According to a first embodiment, pie section actuators or spoke-like actuators can be used. Those actuators allow deformation of the slots to be varied with angle. With reference to spoke-like actuators, the z-displacement of a spoke is uniform along the spoke displacement and varies smoothly with polar angle.

According to a second embodiment, an inflatable membrane bladder can be provided to serve as the insulating layer 40 of FIG. 14. FIGS. 15A and 15B show a membrane bladder 46 to be placed under the upper layer 38. The membrane bladder 46 is able to change its inflated condition by means of a piston device 47. Inflation of the bladder 46 can be obtained by means of a dielectric hydraulic fluid that properly distributes the forces and allows smooth control. The bladder wall can be molded to vary in thickness and stretch.

According to a third embodiment, a plurality of dielectric rods 48 can be provided, as shown in FIG. 16, where only a portion of those rods is shown, for the sake of clarity. The dimension of the rods 48 is much less than the wavelength of the radiation. The rods 48 are pushed inward or retracted from the bottom of the guide through a screen mesh 49. The depth of penetration determines the local phase shift. The rods 48 are inserted in pie-shaped directions according to tilt angle and direction. The small size of the rods will allow to pass the TEM mode smoothly below the cutoff frequency for the higher order modes.

According to a fourth embodiment, a pair of wedged disks is used. The wedged disks can either be flat wedges 50, 51, as shown in FIGS. 17A and 17B, or polar angle contoured wedges 52, 53, as shown in FIGS. 17C and 17D. FIGS. 17A and 17C show a 0 degrees tilt. FIGS. 17B and 17D show full tilt compensation. Rotation of both wedges allows azimuth variation. The conical reflector 42 of FIG. 14 is not shown, for clarity purposes. Additionally, the person skilled in the art will note that an elevation control actuator and an azimuth control actuator will be provided. The wedged disks change the filling percentage of the guide and can be aligned at random azimuth angles and arbitrary elevation corrections within their range. This can be used to null out the maximum corrections required for a given tilt angle. In the flat wedge example of FIGS. 17A and 17B the polar angle corrections are correct at only one pair of positions. The other positions can be compensated by distortion of the slots or spirals. On the other hand, the embodiment of FIGS. 17C and 17D, where the wedges are modeled to be linear in polar angle dependence, allows the bulk of the polar angle error to be removed.

According to a fifth embodiment, the angular dependence can be ignored and simple linear compression can be used to control the guide. The use of deformable slots will allow second order errors to be corrected.

Additional choices for the media include, for example, non-linear dielectrics, media near phase changes, or loaded dielectrics.

While several illustrative embodiments of the invention have been shown and described, numerous variations and alternative embodiments will occur to those skilled in the art. Such variations and alternative embodiments are contemplated, and can be made without departing from the scope of the invention as defined in the appended claims.

What is claimed is:

1. A steerable slot antenna comprising:

an upper plate having an array of T-shaped slots arranged in a pattern having a shape;

a plurality of actuators to control the shape of the pattern by repositioning plural slots of the array of T-shaped slots;

a waveguide comprising a dielectric medium, the waveguide connected with the upper plate; and a lower plate connected with the waveguide.

2. The antenna of claim 1, further comprising a plurality of segments, each segment containing at least a portion of a T-shaped slot of the array of T-shaped slots.

3. The antenna of claim 2, wherein the segments are made of metal sheets.

4. The antenna of claim 2, wherein the segments are made of metalized insulator sheets.

5. The antenna of claim 1, wherein the pattern has a substantially spiral shape.

6. The antenna of claim 5, wherein the shape of the array is controlled along a diameter of the spiral.

7. The antenna of claim 5, wherein the shape of the array is controlled along an axis of the spiral.

8. The antenna of claim 1, wherein the pattern has a substantially circular shape.

9. The antenna of claim 1, wherein the T-shaped slots are arranged in a plurality of nested substantially circular rings, each ring having a ring pattern which is controllable through simultaneous movement of the slots forming the ring.

10. The antenna of claim 1, wherein the shape of the array is controlled in a tilting direction.

11. The antenna of claim 2, wherein the shape of the pattern is controlled by simultaneous movement of at least a portion of the plurality of segments along a radius.

12. The antenna of claim 11, wherein the segments of the plurality of segments comprise pivoting elements to allow orientation of the segments relative to an angle.

13. The antenna of claim 11, wherein the segments of the plurality of segments comprise spring elements to provide torque control of the segments.

14. The antenna of claim 2, wherein the shape of the pattern is controlled by contraction or expansion of the shape through simultaneous translational movement of the plurality of segments.

15. The antenna of claim 2, further comprising a tensioning cable provided along the plurality of segments, wherein movement of the plurality of segments is obtained by releasing or applying tension to the tensioning cable.

16. The antenna of claim 2, wherein the shape of the array is controlled by controlling height of the segments of the plurality of segments.

17. The antenna of claim 1, wherein the dielectric medium is dielectric foam.

18. The antenna of claim 1, wherein the waveguide is a planar waveguide.

19. The antenna of claim 1, wherein the dielectric medium has a deformable shape.

20. An antenna comprising:

an upper plate comprising an array of slots;

a lower plate;

a deformable dielectric medium connecting the upper plate with the lower plate to control a distance between the upper plate and the lower plate, whereby the upper plate, the dielectric medium and the lower plate form a planar waveguide; and a conical reflector placed within the dielectric medium.

21. The antenna of claim 20, further comprising a low noise block (LNB) connected with the conical reflector.

22. The antenna of claim 20, wherein the upper plate further comprises a plurality of metallic plates supporting the slots.

23. The antenna of claim 22, wherein the metallic plates are movable, thereby changing at least one between location and pointing angle of the slots.

24. The antenna of claim 20, wherein the deformable dielectric medium comprises foam dielectric.

25. The antenna of claim 20, wherein the array of slots comprises deformable slots.

26. The antenna of claim 20, wherein the deformable dielectric medium comprises an inflatable membrane bladder.

27. The antenna of claim 26, further comprising a piston device to control inflation of the inflatable membrane bladder.

28. A dual polarization slotted antenna comprising an array of independently rotatable slots, wherein rotation of the slots is controlled to allow polarization diversity.

29. The antenna of claim 28, wherein the array of slots has a spiral shape.

30. The antenna of claim 28, wherein the array of slots has a shape of a plurality of nested rings.

31. The antenna of claim 28, wherein the slots are continuously rotatable.

32. The antenna of claim 28, wherein the slots are provided with a discrete number of possible rotations.

33. The antenna of claim 28, wherein some slots of the array of slots are blocked and do not contribute to coupling of an electromagnetic wave.

34. The antenna of claim 28, wherein the slots are T-shaped slots.

35. A steerable antenna comprising:

an upper plate having a plurality of ridged mesa elements, wherein orientation and positioning of the mesa elements is controllable, to allow repositioning of the mesa elements along the upper plate;

an insulating layer connected with the upper plate; and a lower plate connected with the insulating layer.

36. The antenna of claim 35, wherein each mesa element is connected to a gland section.

37. A steerable antenna comprising:

an upper plate having a plurality of elements having a deformable height, wherein the height and position of the elements is controllable;

an insulating layer connected with the upper plate; and a lower plate connected with the insulating layer.

38. The antenna of claim 37, wherein each element has an inflated condition and a deflated condition, the height of the element in the inflated condition being different from the height of the element in the deflated condition.

* * * * *